US011002508B2

(12) United States Patent
Miller et al.

(10) Patent No.: US 11,002,508 B2
(45) Date of Patent: May 11, 2021

(54) MULTI-SHOT AIRGUN

(71) Applicant: Crosman Corporation, Bloomfield, NY (US)

(72) Inventors: James Miller, Victor, NY (US); Jeffrey W. Mock, Rochester, NY (US)

(73) Assignee: Crosman Corporation, Bloomfield, NY (US)

( * ) Notice: Subject to any disclaimer, the term of this patent is extended or adjusted under 35 U.S.C. 154(b) by 0 days.

(21) Appl. No.: 16/577,778

(22) Filed: Sep. 20, 2019

(65) Prior Publication Data

US 2020/0096287 A1 Mar. 26, 2020

Related U.S. Application Data

(60) Provisional application No. 62/733,932, filed on Sep. 20, 2018.

(51) Int. Cl.
*F41B 11/50* (2013.01)
*F41B 11/70* (2013.01)

(52) U.S. Cl.
CPC ..... *F41B 11/50* (2013.01); *F41B 11/70* (2013.01)

(58) Field of Classification Search
CPC ..... F41B 11/50; F41B 11/62; F41B 11/648; F41B 11/70; F41A 3/58
USPC ..... 124/45, 48, 65, 66, 67; 42/75.04
See application file for complete search history.

(56) References Cited

U.S. PATENT DOCUMENTS 578,820 A * 3/1897 Hornhauer ..... F41B 11/647 124/67
891,211 A * 6/1908 Driver et al. ..... F41B 11/50 124/82
2,194,142 A * 3/1940 Foss ..... F41B 11/648 124/67
2,572,176 A * 10/1951 Mihalyi ..... F41B 11/648 124/67
3,908,626 A * 9/1975 Hammond ..... F41B 11/648 124/67
3,924,599 A * 12/1975 Hammond ..... F41B 11/648 124/67
4,367,723 A * 1/1983 Resuggan ..... F41B 11/646 124/67
4,774,929 A * 10/1988 Milliman ..... F41B 11/648 124/76

(Continued)

FOREIGN PATENT DOCUMENTS

GB 978502 12/1964

*Primary Examiner* — Alexander R Niconovich
(74) *Attorney, Agent, or Firm* — Lee & Hayes, P.C.

(57) ABSTRACT

Airguns are provided. In one aspect, a shuttle having a breech bushing therein is moved between a cocking position where a projectile is loaded into a breach bushing channel and a firing position where the breech bushing channel is located between a port from which compressed air flows firing and a barrel opening into which the compressed air advances the projectile. The barrel has a barrel guide surface at the back barrel face, wherein the breech bushing has a shaped surface facing the barrel and wherein the breech bushing shaped surface and the barrel guide surface are configured to interact as the barrel is moved from the cocked position to the firing position to urge the breach insert to move within the shuttle passageway in a manner that reduces the extent of any misalignment between the breech bushing channel and the opening.

14 Claims, 8 Drawing Sheets

(56) References Cited

U.S. PATENT DOCUMENTS 4,883,042 A * 11/1989 Wackrow ..... F41B 11/646 124/67
5,160,795 A * 11/1992 Milliman ..... F41A 19/53 124/48
5,205,271 A * 4/1993 Casas Salva ..... F41B 11/00 124/65
5,285,766 A * 2/1994 Milliman ..... F41B 11/54 124/48
5,341,790 A * 8/1994 Ebert ..... F41B 11/62 124/69
5,570,676 A * 11/1996 Gore ..... F41B 11/642 124/56
5,575,270 A * 11/1996 Casas-Salva ..... F41B 11/648 124/67
5,632,264 A * 5/1997 Barker ..... F41B 11/648 124/67
5,655,509 A * 8/1997 Casas Salva ..... F41B 11/648 124/66
6,539,659 B2 * 4/2003 Casas Salva ..... F41C 7/11 42/75.04
9,903,676 B2 * 2/2018 Calvete ..... F42B 5/38
9,995,556 B2 * 6/2018 Hall ..... F41C 23/16
10,288,375 B2 * 5/2019 Spreadbury, III ..... F41B 11/648
10,697,731 B2 * 6/2020 Calvete ..... F41C 23/16
2006/0064911 A1 * 3/2006 Lewis ..... F41B 11/648 42/54
2010/0229844 A1 * 9/2010 Gore ..... F41B 11/642 124/80
2013/0247438 A1 * 9/2013 Torre ..... F41A 3/66 42/75.03
2016/0273872 A1 * 9/2016 Steele ..... F41C 9/085
2017/0089664 A1 * 3/2017 Kras ..... F41B 11/62
2018/0031349 A1 * 2/2018 Malheiros ..... F41B 11/648
2018/0252492 A1 * 9/2018 Spreadbury, III ..... F41B 11/648
2018/0252493 A1 * 9/2018 Heckert ..... F41B 11/648
2019/0204046 A1 * 7/2019 Calvete ..... F41A 3/58
2020/0232749 A1 * 7/2020 Call ..... F41B 11/55
2020/0271412 A1 * 8/2020 Calvete ..... F41A 3/58

* cited by examiner

MULTI-SHOT AIRGUN

CROSS REFERENCE TO RELATED APPLICATIONS

This application claims the benefit of U.S. Provisional Patent Application No. 62/733,932, filed on Sep. 20, 2018.

FIELD OF THE INVENTION

Airguns of the break barrel type.

BACKGROUND OF THE INVENTION

Conventional break barrel air guns provide a stock and receiver that are joined to a barrel by way of a hinge. The receiver houses a spring into which energy is stored, a trigger for releasing the stored energy of the spring to drive a piston into a compression tube having a transfer port that communicates pressure from the compression tube to a breech end of the barrel. In such air guns, the barrel is hingedly joined to the receiver. When the user wishes to use the break barrel airgun, the user rotates the barrel relative to the stock and receiver. This separates the breech end of the barrel from the transfer port allowing a pellet to be loaded therein. After loading the user rotates the barrel to a position where the breech end of the barrel is positioned proximate to the transfer port. The barrel is also connected to the spring in a manner that causes the energy to be stored in the spring as the break barrel is moved during the loading process.

While the acts of rotating the barrel to and from the loading position can be conducted rather quickly. The process of manually loading an individual pellet into the breech end of a barrel while holding an air rifle can be challenging and can extend the time between shots significantly.

What is needed is a break barrel airgun that can load pellets automatically during the cocking action.

BRIEF SUMMARY OF THE INVENTION

Airguns are provided. In one aspect the airgun has a tube fork having front face with a port from which a compressed gas can flow; a barrel having a passageway through the barrel with an opening at a back barrel face, with the passageway sized to receive a projectile, a pivot joining the barrel to the tube fork such that the barrel can be moved between a firing position and a cocking position; a shuttle positioned between the port and the barrel the shuttle having a shuttle passageway with a front end of the shuttle passageway that is larger than at least one of the barrel passageway and the port; a shuttle drive system configured to allow the shuttle to move so that the shuttle passageway is moved between a firing position where a front end of the shuttle passageway overlaps the opening and where a back end of the shuttle passageway overlaps the port and a loading position where the shuttle passageway overlaps a loading opening of a projectile loading system; and, a breech bushing partially in the shuttle passageway and having a breech bushing channel a sized to receive the projectile. The barrel has a barrel guide surface at the back barrel face, the breech bushing has a shaped surface facing the barrel and the breech bushing shaped surface and the barrel guide surface are configured to interact as the barrel is moved from the cocked position to the firing position to urge the breech bushing to move within the shuttle passageway in a manner that reduces the extent of any misalignment between the breech bushing channel and the opening.

DESCRIPTION OF THE INVENTION

Figure 1:
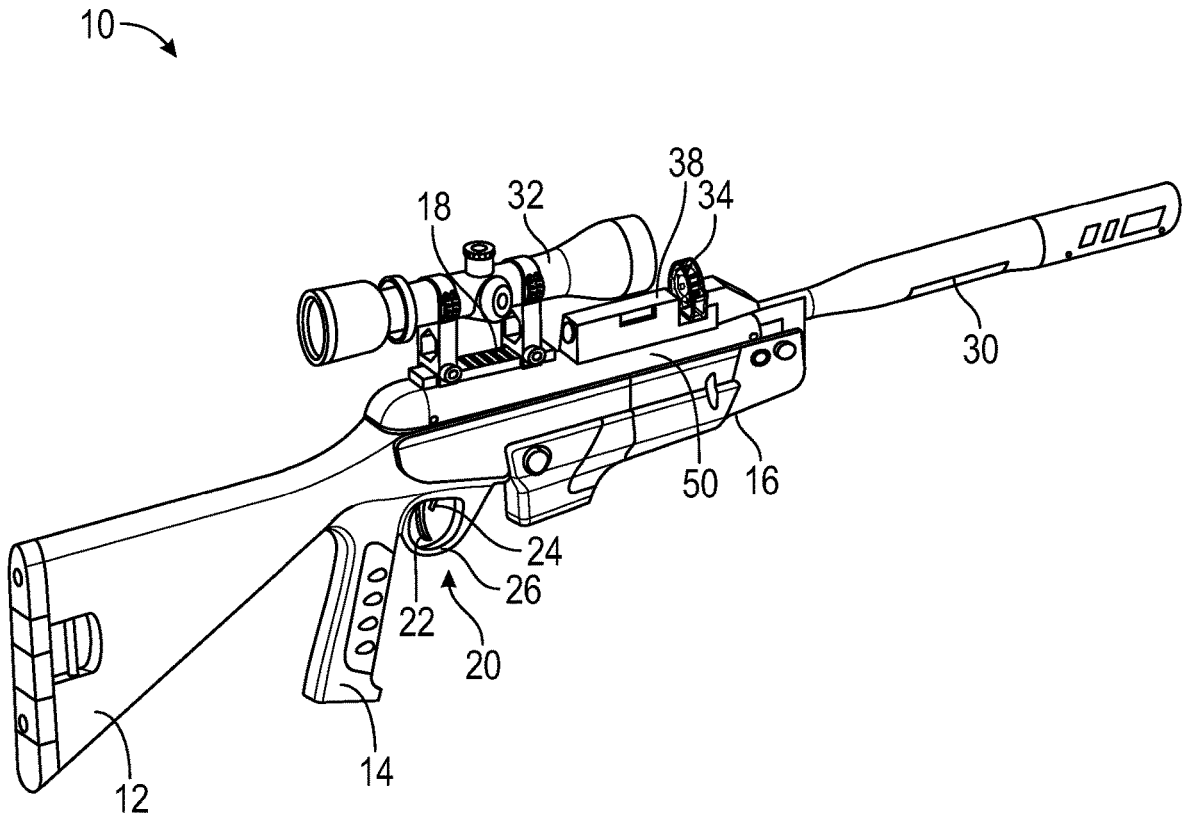
FIG. 1 is a back, right, top perspective view of a rifle of one embodiment of the invention in a firing position.
Figure 2:
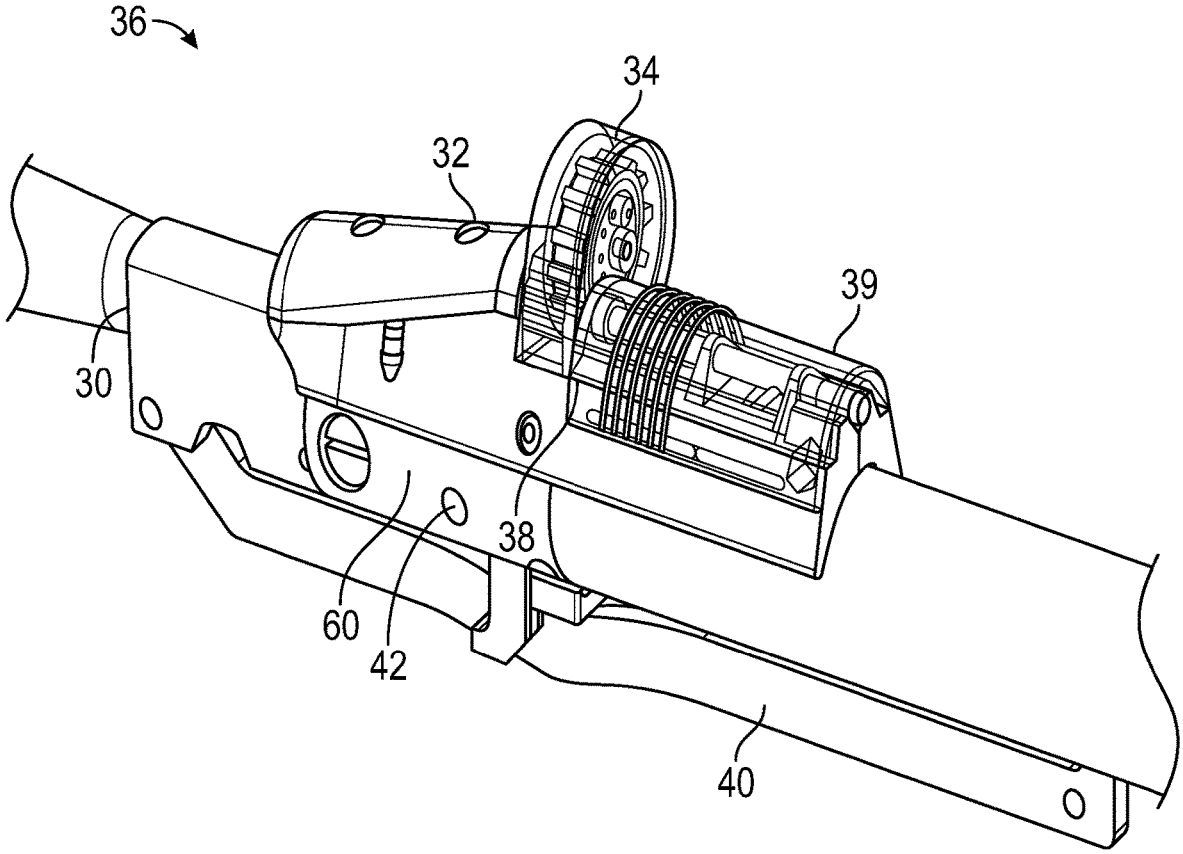
FIG. 2 is a front, left, top perspective view of a cocking and loading mechanism cut away from the embodiment of FIG. 1 and with a front forestock removed.
Figure 3:
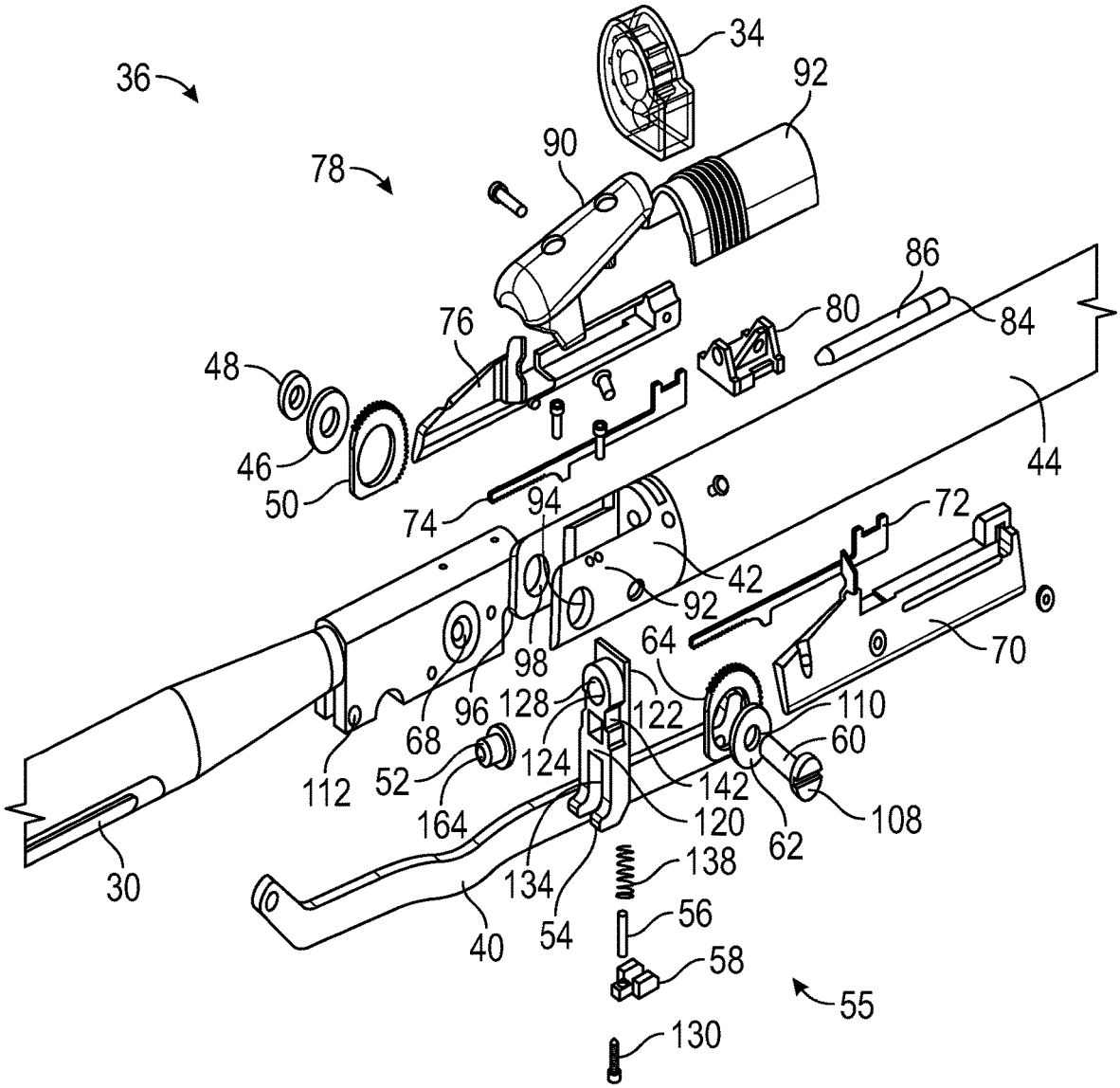
FIG. 3 is a front, left, top perspective view of a cocking and loading mechanism cut away from the embodiment of FIG. 1 and with a front forestock removed.
Figure 4:
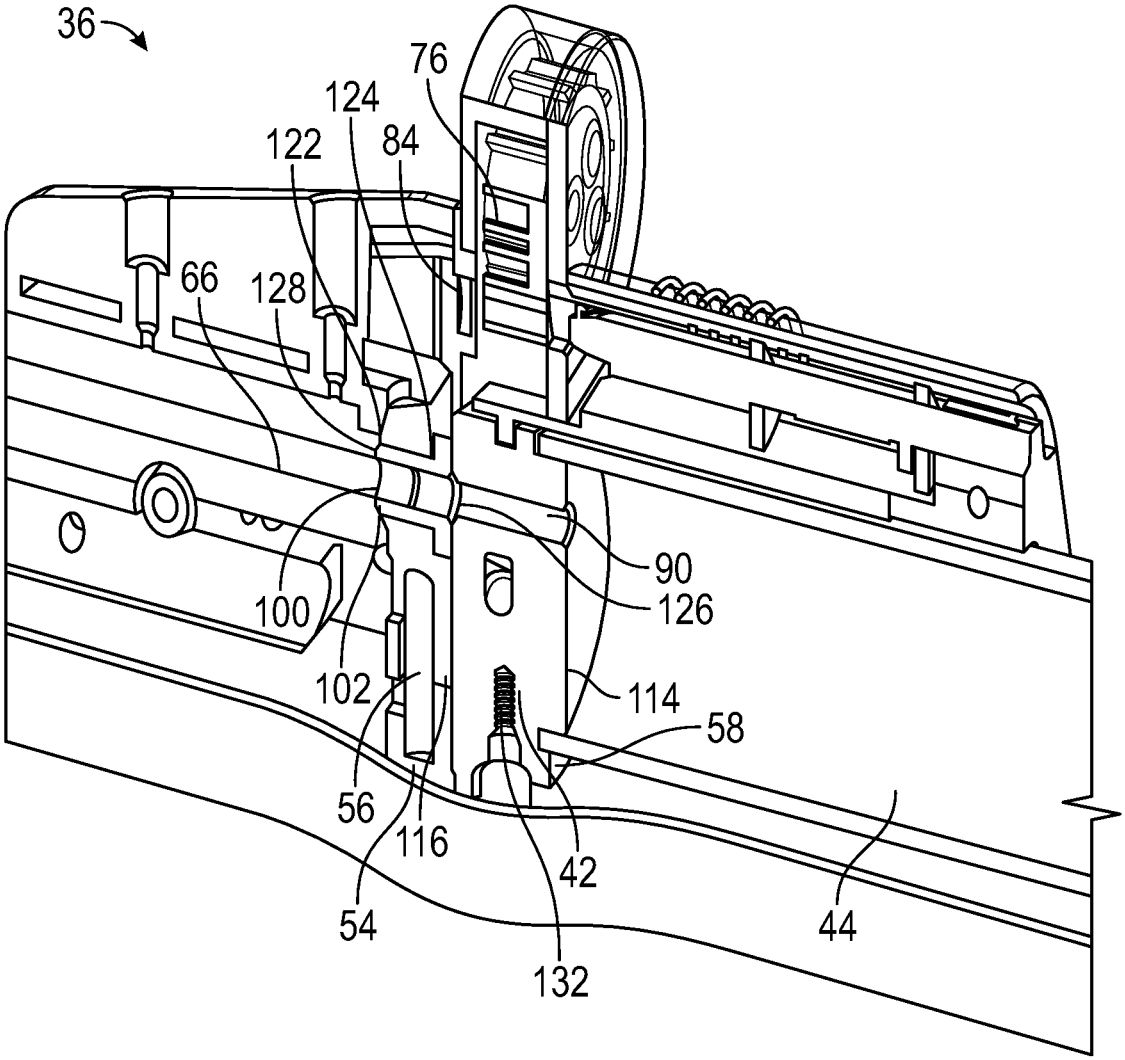
FIG. 4 is a rear, left, top perspective view of a cocking and loading mechanism of the embodiment of FIG. 1 in cross section with portions of the loading system cut away.

FIG. 1 is a back, right, top perspective view of a rifle of one embodiment of the invention in a firing position, FIG. 2 is a cut away view of the embodiment of FIG. 1 front, left, top perspective view of a cocking and loading mechanism cut away from the embodiment of FIG. 1 and with a front forestock removed, FIG. 3 is a front, left, top perspective view of a cocking and loading mechanism cut away from the embodiment of FIG. 1 and with a front forestock removed, FIG. 4 is a rear, left, top perspective view of a cocking and loading mechanism of the embodiment of FIG. 1 in cross section with portions of loading mechanism 78 cut away.

In the embodiment of FIGS. 1-4, air gun 10 has stock 12 with a grip handle 14, forestock 16 mounting rail 18, a trigger system 20, with a trigger 22, a safety 24 and trigger guard 26. Airgun 10 also has a barrel 30 through which projectiles (not shown) such as pellets are thrust toward a target. In this embodiment a loading system 36 holds a magazine 34 containing a plurality of projectiles in a magazine holder 38.

Cocking and loading system 36 can comprise in this embodiment, a barrel 30, tube fork 42, a piston tube 44, a shuttle 54, a shuttle drive 55, a loading mechanism 78, and a bolt latch slider 80. Barrel 30 has a load longitudinal passageway 66 generally extending along a length of barrel 30 beginning at a barrel opening 100 in a barrel back face 102 of barrel 30. Longitudinal passageway 66 is sized to receive projectiles of predetermined length and width and may be of a smooth bore type or may have rifling along some or all of a length of barrel 30. Barrel 30 also has a pivot mount 68 arranged in this embodiment along an axis that is generally orthogonal to the longitudinal axis and sized so that a pivot bolt 60 can pass there through. Barrel 30 is shaped and sized so that a portion of barrel 30 proximate to barrel back face 102 can be positioned between a first fork 92 and a second fork 96 of tube fork 42.

First fork 92 has a first pivot bolt passageway 94 sized to receive pivot bolt 60 while a second pivot bolt passageway 98 is provided in second fork 96 and likewise sized to receive pivot bolt 60. Barrel 30 is assembled to tube fork 42 by aligning pivot mount 68 with first pivot bolt passageway 94 and second pivot bolt passageway 98 to provide a path through which pivot bolt 60 may be inserted. In this embodiment pivot bolt 60 has a screw cap 106 at a first end 108 and a second end 110 to which a pivot nut 48 can be joined. During assembly of barrel 30 and tube fork 42, a spacer 62 and left spur gear 64 are positioned between first end 108 and second end 110 of pivot bolt 60 and second end of pivot bolt 60 is then passed through first pivot bolt passageway 94, pivot mount 68 and second pivot bolt passageway 98. Right spur gear 50 and spacer 46 are then positioned on pivot bolt 60 between second pivot bolt passageway 98 and second end 110. Pivot nut 48 is then joined to second end 110 to provide a predetermined distance between pivot nut 48 and screw cap 106 or to provide a predetermined clamping force between pivot nut 48 and screw cap 106. This arrangement allows barrel 30 and tube fork 42 to pivot relative to each other between a firing position as shown in FIGS. 1-4 and a cocking position shown in FIGS. 5-7.

A cocking lever 40 is joined to barrel 30 between a first pivot point 112 and an energy storage device such as a spring or gas piston (not shown) such that as barrel 30 is moved from firing position to the cocking position and back energy is stored in the energy storage device. When trigger system 20 is activated, this energy is released to drive a piston toward an inner face 114 of tube fork 42 so as to force compressed air into to a tube fork port 90 that provides a path through tube fork 42 from inner face 114 to outer face 116.

A shuttle 54 is positioned between barrel back face 102 and an outer face 116 of tube fork 42. Shuttle 54 has a shuttle front face 120 confronting barrel back face 102 and a shuttle back face 122 confronting outer face 116 of tube fork 42. Shuttle 54 has a shuttle passageway 124 between shuttle front face 120 and shuttle back face 122. Shuttle drive system 55 is connected to barrel 30 and to tube fork 42 or some other component of air gun 10 that generally remains stationary relative to tube fork 42 as barrel 30 when barrel 30 is moved between the cocked position and the firing position. When barrel 30 is in the firing position as is illustrated in FIGS. 1-4, shuttle drive system 55 positions shuttle 54 such that a shuttle passageway back end 126 is grossly aligned with tube fork port 90 and such that a front end 128 of shuttle passageway 124 is grossly aligned with barrel opening 100 of longitudinal passageway 66.

Shuttle drive system 55 includes a spring cap 58 that is mechanically associated with tube fork 42 for example by way of threading a threaded fastener 130 into a tapped hole 132. Spring cap 58 positions a center pin 56 and shuttle 54 has a center cavity 134 designed to permit sliding motion of shuttle 54 relative to center pin 56 and any structures assembled about center pin 56 such as for example spring type resilient member 138.

Figure 5:
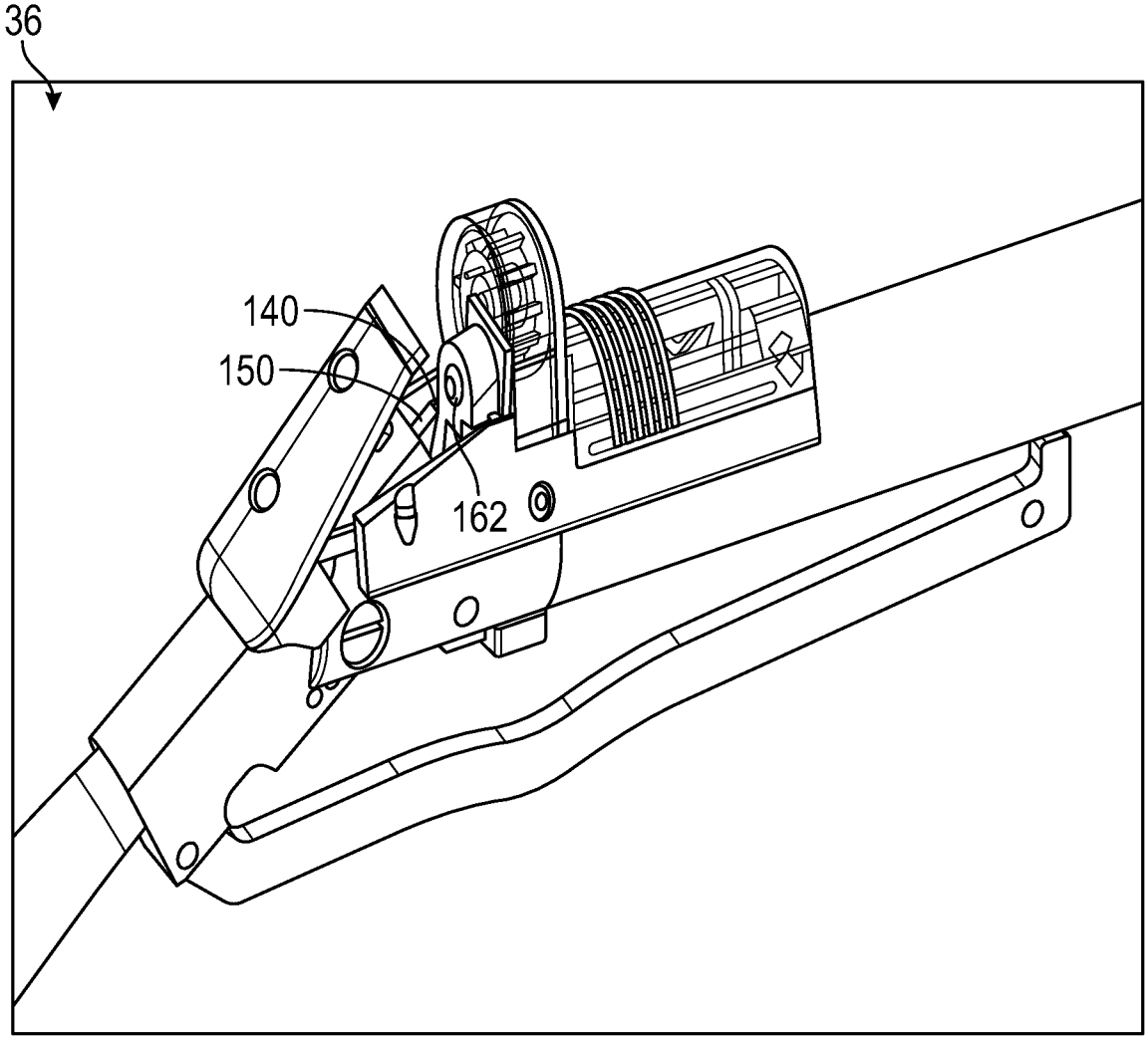
FIG. 5 is front, right, top perspective view of a cocking and loading mechanism of the embodiment of FIG. 1 in a cocking position.
Figure 6:
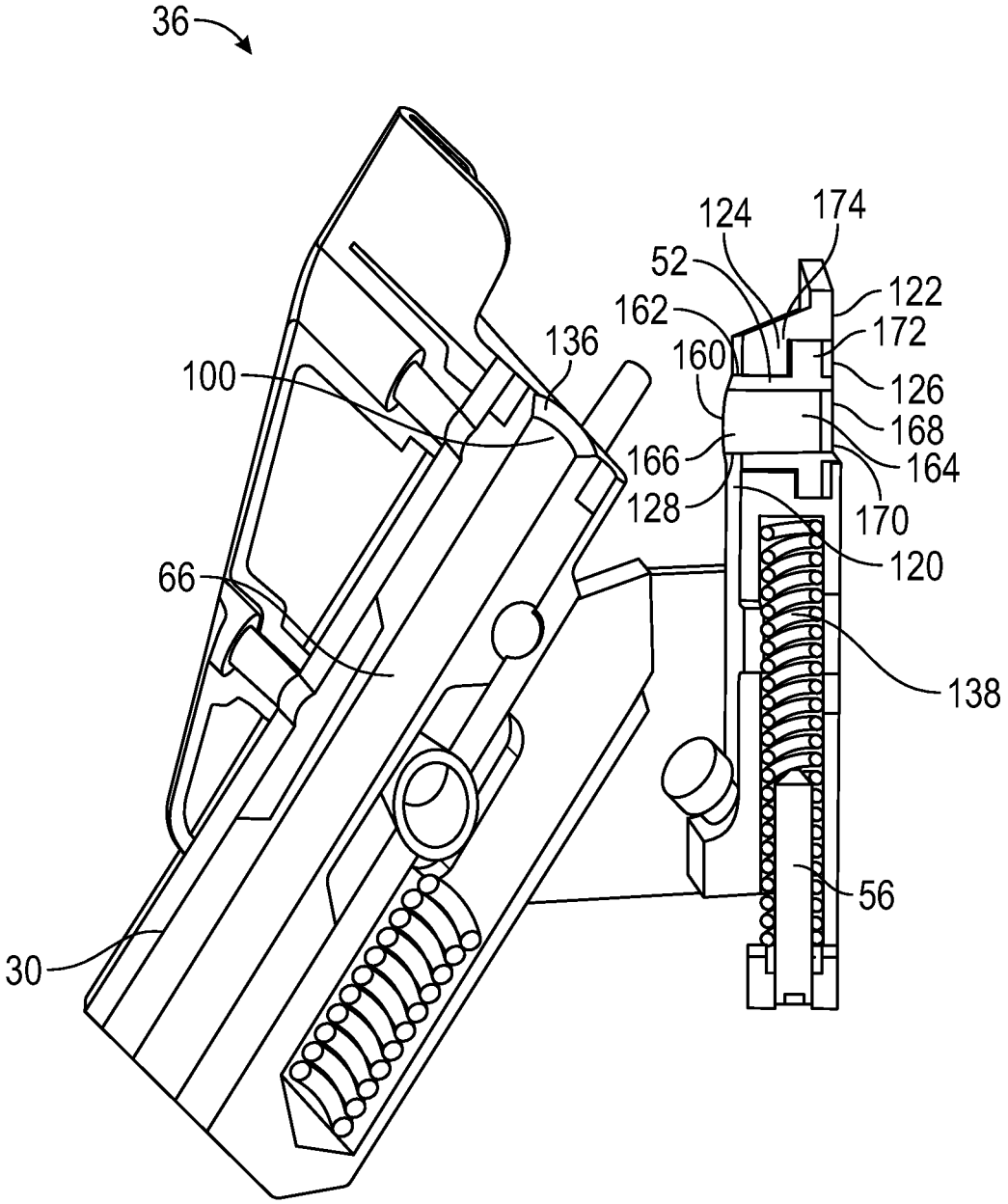
FIG. 6 is a side, section view of the cocking and loading mechanism in a cocking position.
Figure 7:
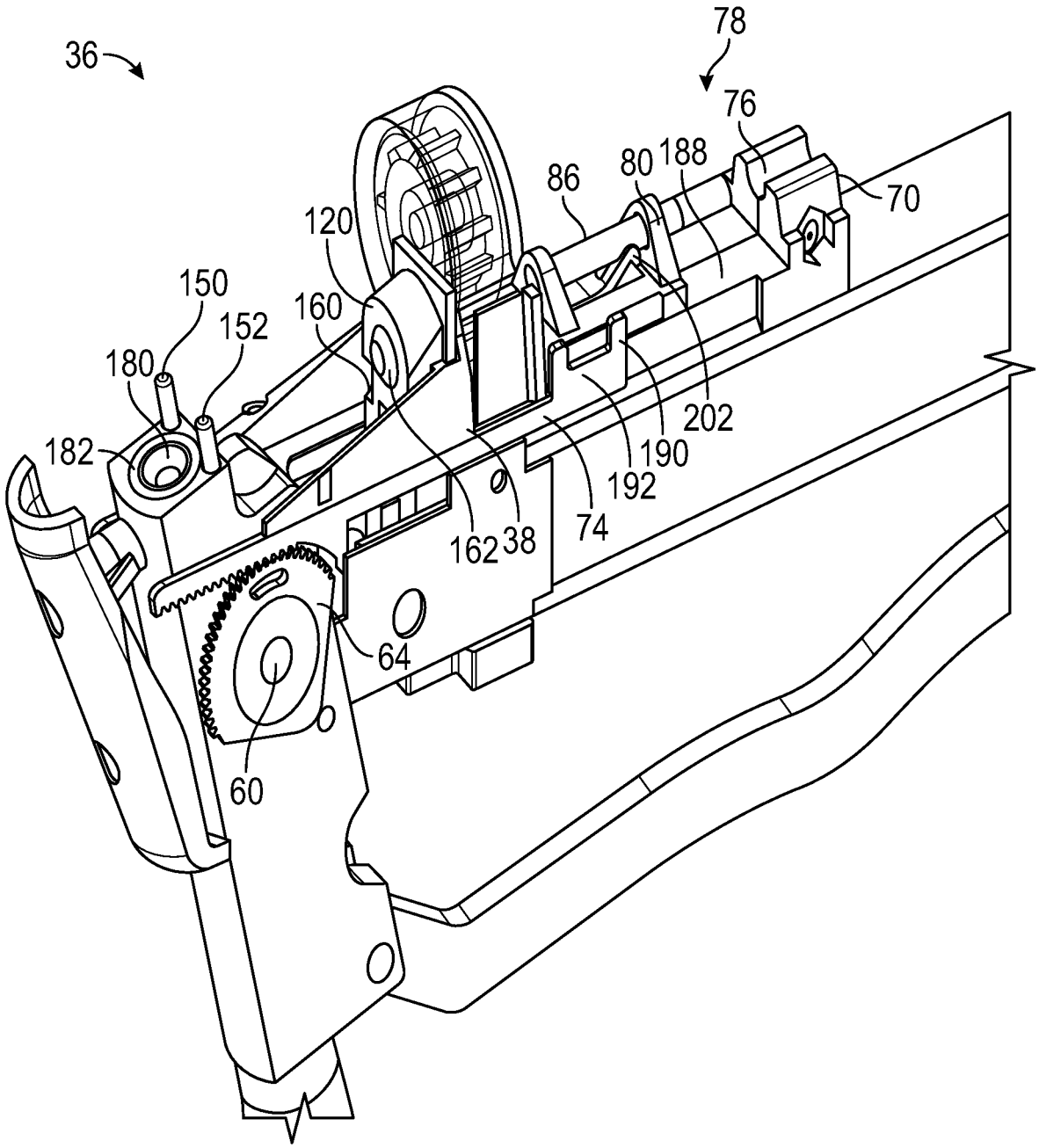
FIG. 7 is a left, front, top perspective view of the cocking and loading mechanism in a cocking position.
Figure 8:
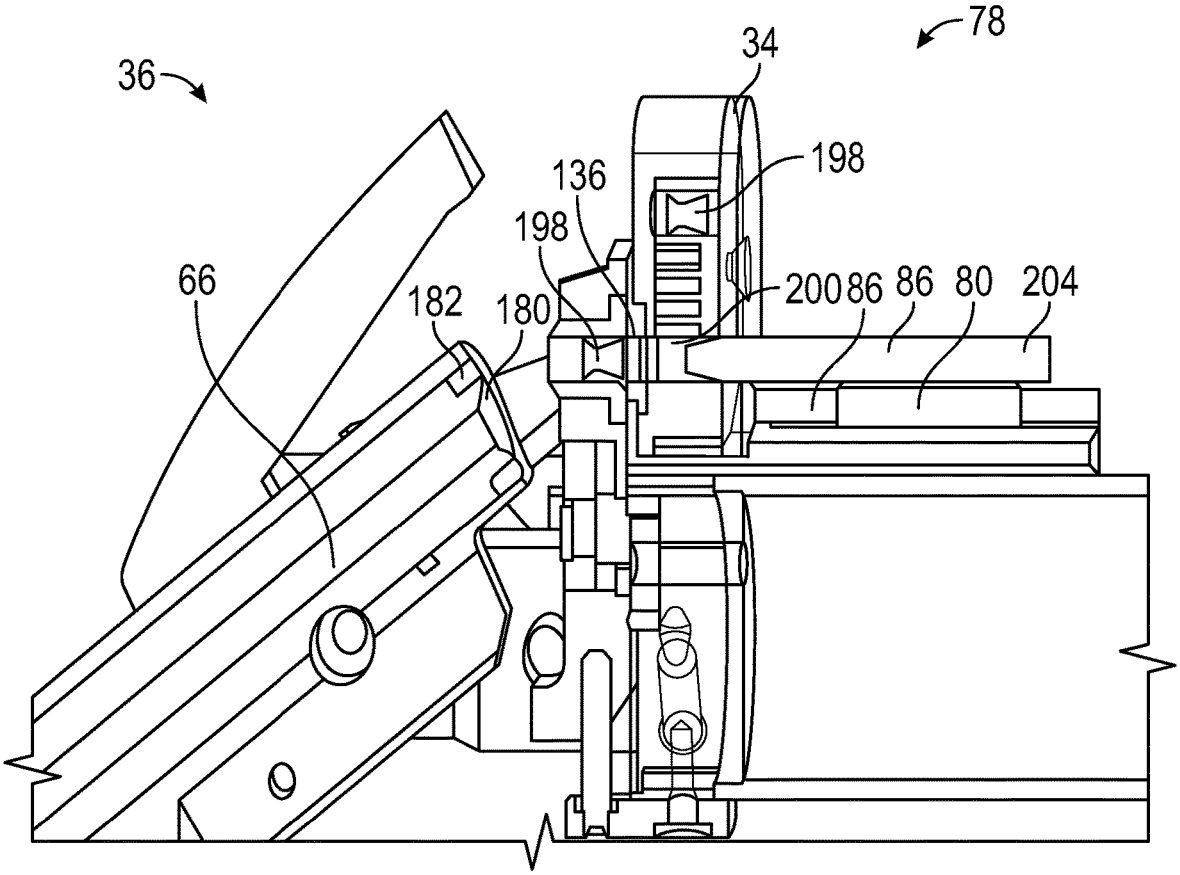
FIG. 8 is a side, section view of the cocking and loading mechanism in a cocking position.

FIGS. 5-8 illustrate cocking and loading system 36 of the embodiment of FIG. 1 in a cocking position. Specifically, FIG. 5 is front, right, top perspective view of a cocking and loading mechanism of the embodiment of FIG. 1 in a cocking position. FIG. 6 is a side section view of the cocking and loading mechanism in the cocking position. FIG. 7 is a left, front, top perspective view of the cocking and loading mechanism in a cocking position. FIG. 8 is a side section view of the cocking and loading mechanism after loading.

As is shown in FIGS. 5-8, in this position shuttle 54 is repositioned along center pin 56 such that shuttle passageway back end 126 is grossly aligned with a loading opening 136 through which a bolt 86 can advance a projectile into shuttle passageway 124. After loading shuttle drive 55 returns shuttle 54 to the firing position such that shuttle passageway 124 such that pressurized air from tube fork port 90 will thrust such a projectile toward longitudinal passageway 100 in barrel 30. In FIGS. 7 and 8, portions of the left housing 70 and right housing 76 have been removed so that the operation of loading mechanism 78 can be shown.

The use of such a shuttle 54 for loading provides a projectile that is positioned in shuttle passageway 124 during firing. This in turn requires that effective seals be established between front face of tube fork 42 and shuttle passageway back end 126 of shuttle passageway 124 as well as between shuttle front face 120 and barrel back face 102. Further this arrangement requires precise alignment of tube fork port 90 with the back end of shuttle passageway 124 to prevent turbulent air flows that might consume a portion of the energy in the compressed air supplied from tube fork port 90 during firing. Still further such a system requires that front end of shuttle passageway 124 be precisely aligned with barrel opening 100 of longitudinal passageway 66 of barrel 30. Misalignment at this point can cause turbulent air flow and energy loss as well. However such misalignment also presents the risk that a pellet or other projectile with be partially thrust against barrel back face 102 of barrel 30 which can cause damage to the projectile and causing inaccurate fire or can cause a pellet or other projectile to be jammed at the interface between barrel back face 102 and shuttle 54. Similarly, misalignment of shuttle passageway back end 126 with loading opening 136 can result in damage to a pellet or jamming incidents. Jamming between barrel 30 and loading opening 136 can also occur in the even that a user mistakenly loads more than one projectile into shuttle passageway 124.

It will be appreciated that such misalignment can happen in various ways, along a vertical axis, along a horizontal axis, or both as may occur in the event that shuttle 54 is allowed to slide vertically at a cant and that given the requirements for alignment, thermal and other environmental factors can also impact alignment.

Such concerns place a significant burden on the design of such a system in that a conventional manner of addressing such requirements is to impose exacting constraints on the design of such systems and the materials used such a system. One example of such a system is shown in U.S. Pat. No. 5,772,382, entitled "Loading Plate for a Repeat-Air Rifle for Pellets and Ammunition" issued Orozco, on Mar. 3, 1998. However, such approaches add cost, weight, and complexity which may not be useful in field environments. Alternatively, user adjustment controls can be provided as described in GB978,502 entitled Improvements in or relating to Air or Gas Pressure Guns issued to Vesely et a. and published on Dec. 23, 1964. However, this leads to the need for constant adjustments and creates usability problems.

In the embodiment of loading and cocking system 36 shown here, shuttle 54 is biased by a resilient member 138 that, in this embodiment, is shown as a coil spring that is positioned about pin 56 and that provides a centered thrust urging shuttle 54 away from the firing position toward the loading position. Shuttle 54 provides bilateral shoulders 140 and 142 that are arranged to interact with positioning beams 150 and 152 that project from barrel back face 102 such that as positioning beams 150 and 152 rotate with barrel 30 about pivot bolt 60 through a radius that brings positioning beams 150 and 152 into contact with shoulders 140 and 142 as barrel 30 is rotated from the cocking position to the firing position. The force provided against shoulders 140 and 142 positively drives shuttle 54 against the bias of spring type resilient member 138 to provide bilateral vertical position control over shuttle 54. This further constrains the extent to which canting of shuttle 54 can cause misalignment. Additionally, this provides for vertical positioning of shuttle 54 relative to barrel 30 using reference surfaces that are proximate to barrel 30 and to shuttle passageway 124. This has the effect of limiting the extent to which thermal effects can cause misalignment. It will also be noted that the use, in this embodiment, of beams 150 and 152 with a rounded shape provides tangential contacts with shoulders 140 and 142 such that in the event that foreign materials such as dust, dirt, or grime gets into this system the contact will urge materials away from contact points preserving alignment and positioning.

Even using such an approach, maintaining precise alignment and positioning of a movable slide relative to barrel opening 100 and tube fork port 90 remains challenging. In particular, it is challenging to provide such alignment while maintaining a lightweight and easy to use air gun. For example, if dissimilar materials are used for barrel 30, tube fork 42 and shuttle 54, differences in the rate of thermal expansion can cause differences in alignment that can be difficult to match. As barrel 30 and tube fork 42 are typically made of metal, this tends to require that shuttle 54 likewise be made of metal. Such a decision increases the cost and weight of the air gun 10.

The embodiments of FIGS. 1-8 offer solutions to such problems. As can be seen in these embodiments, shuttle passageway 124 has a larger cross sectional area than do barrel opening 100 or tube fork port 90 and is sized and shaped to receive a breech bushing 52. In the embodiment of FIGS. 1-8, breech bushing 52 has a front end 160 with a breech bushing shaped surface 162, and a breech bushing channel 164 extending from a front opening 166 at front end 160 to a back opening 168 at a back end 170 of breech bushing 52.

As shown, breech bushing 52 has a length between front end 160 and back end 170 that is greater than a length between shuttle front face 120 and shuttle back face 122. Further breech bushing 52 has a lateral extension 172 extending outwardly in a direction that is not parallel to a direction of breech bushing channel 164 which may for example take the form of a circumferential flange as shown here or which may take other forms.

In this embodiment, breech bushing 52 is not rigidly joined to shuttle passageway 124 but can move within shuttle passageway 124 within any space provided between breech bushing 52 and shuttle passageway 124. In embodiments, shuttle passageway 124 and breech bushing 52 may be designed so that movement of breech bushing 52 is constrained in certain manners. For example, in this embodiment, breech bushing 52 has a lateral extension 172 extending outwardly in a direction that is not parallel to a direction of breech bushing channel 164 which may for example take the form of a circumferential flange as shown here or which may take other forms and shuttle passageway 124 has a stop 174 positioned therein to interfere with lateral extension 172 to constrain the extent to which breech bushing 52 can move toward front shuttle face 120. This arrangement can be used for example, help retain breech bushing 52 within shuttle passageway 124. Other arrangements are possible.

Further, in this embodiment, where breech bushing 52 has a length between front end 160 and back end 170 that is greater than a length between shuttle front face 120 and shuttle back face 122. This arrangement can be used to help define the extent, if any, to which front end 160 and back end 170 project from shuttle front face 120 and from shuttle back face 122.

As can be seen in FIGS. 6 and 7, in this embodiment breech bushing 52 and shuttle 54 are configured so that breech bushing shaped surface 162 projects from shuttle front face 120. As can also be seen in FIGS. 6 and 7 barrel 30 has a barrel opening 100 with a barrel guide surface 180 that is shaped to interact with co-designed breech bushing shaped surface 162 to further center front opening 166 of breech bushing channel 164 relative to longitudinal passageway 66 when barrel 30 is moved to return cocking and loading system 36 to the firing position. This helps to prevent wasted energy and the risk of accuracy or jamming issues potentially caused by misalignment. Further, in embodiments where there is good positional alignment between longitudinal passageway 66 and tube fork port 90, alignment of breech bushing channel 164 with longitudinal passageway 66 may help to achieve better alignment of breech bushing channel 164 with tube fork port 90. As is also shown in the embodiment of FIGS. 1-8 a seal 182 can be provided on barrel back face 102 to help retain air pressure at the interface between longitudinal passageway 66 and breech bushing channel 164 while a seal (not shown) may be provided.

It will be appreciated from this that, in embodiments, the use of this centering interaction between breech bushing shaped surface 162 and barrel guide surface 180 reduces the extent to which the flow of air from port 90 through opening 100 is dependent on the precision placement of shuttle passageway 124. This reduces the extent to which the proper functioning of airgun 10 is dependent on the use of precision cut high density materials heavy and strong materials to form shuttle 54 and on the extent to which shuttle drive 55 must be capable of precision alignment of shuttle channel 124 under all circumstances.

Similarly, the use of a breech bushing 52 that is separate from the shuttle 54 to hold a projectile can also eliminate any requirement that a shuttle 54 be formed from materials that can provide a shuttle passageway 124 that can be repeatedly clamped between opening 100 and port 90 to form effective seals and that can withstand the powerful bursts of pressurized air that must pass therethrough during discharge of airgun 10. For example, it is possible to define shuttle 54, barrel 30, and tube fork 42 in a manner that applies all or a significant proportion of the a clamping force used to make substantially air tight connections with breech bushing 52 without applying such forces to shuttle 54 or while applying a substantially lower amount of such clamping forces to shuttle 54. In one example, the use of the breech bushing 52 having a length between front end 160 and back end 170 that is greater than a length between shuttle front face 120 and shuttle back face 122 enables a longitudinal clamping force to be applied along breech bushing 52 without necessarily causing the same levels of longitudinal clamping force to be applied to shuttle 54. This permits a tight sealing arrangement to be established from port 90 through breech bushing channel 164 to barrel opening 100 without necessarily requiring that shuttle 54 be capable of repeatably experiencing such loads. Other arrangements for applying such force against breech bushing 52 are possible.

The use of breech bushing 52 can also eliminate the need for shuttle 54 to provide a shuttle passageway 124 that can contain the significant gas pressures that may be emitted by port 90.

Instead, only breech bushing 52 need be made of materials that can be relied upon to be repeatedly compressed between barrel 30 and tube fork 42 with the longitudinal force necessary to maintain an effective seal and in embodiments, and that that can survive high pressures. This provides much greater freedom in allowing shuttle 54 to be made using lightweight materials such as polymeric plastics. Additionally system improvements become possible the use of a shuttle drive system 55 that may be less complex or that may require less adjustment as the requirement for precise placement of a heavy object is eliminated and as wear and other factors associated with the challenges of controlling the movement of a heavy shuttle within a confined space may impose. Further, the broader range of materials that can be used to form shuttle 54 may enable other improvements such as where certain polymers are used to form shuttle 54 that may enable improved slip resistance as the shuttle 54 moves against surfaces, for example, and without limitation a surface of tube fork adjacent to port 90.

Loading of the pellet or projectile is accomplished by way of loading mechanism 78. In this embodiment, loading mechanism 78 comprises right spur gear 50 and left spur gear 64, right gear rack 72 and left gear rack 74, left housing 70, right housing 76, bolt latch slider 80 and bolt 86.

Right spur gear 50 is positioned on pivot bolt 60 on a left side of barrel 30 for rotation with barrel 30 about pivot bolt 60. Similarly, left spur gear 64 is positioned on pivot bolt 60 on a left side of barrel 30 for rotation with barrel 30 about pivot bolt 60.

Left housing 70 and right housing 76 are joined together and to tube fork 42 or other components of air gun 10 and provide mountings to which left gear rack 74 and right gear rack 76 can be mounted for slidable longitudinal movement relative thereto. When assembled, left housing 70 and right housing 76 further provide a slide path 188 on which bolt latch slider 80 can be moved longitudinally between a forward and a rear position. FIG. 7 illustrates an example of engagement between left spur gear 64 and left gear rack 74. As can be seen from FIG. 7, when cocking and loading system 36 is in the cocking position, left gear rack 74 is drawn forward. Left gear rack 74 in turn has engagement features 190 that engage engagement features 192 of bolt latch slider 80 so that movement of left gear rack 74 causes movement of bolt latch slider 80. Although not visible in FIG. 7, right spur gear 50 and right gear rack 72 and bolt latch slider 80 interact in a complimentary fashion so that generally equivalent forces are applied against bolt latch slider to cause bolt latch slider 80 to move with generally even forces being applied on each side. Single sided arrangements are possible.

As is shown in FIGS. 7 and 8, left housing 70 and right housing 76 also combine to form a magazine holder 38 that holds a magazine 34 so that bolt 86 can be advanced through a pellet storage chamber 200 of magazine 34 to drive a pellet 198 into breech bushing 52 as bolt latch slider 80 is moved from the rearward position to the forward position.

In the embodiment of FIG. 8, bolt 86 is held for movement with bolt latch slider 80 by a resilient member 202. Resilient member 202 holds bolt 86 with sufficient force to drive a single pellet into breech busing 52 without substantially displacing bolt 86 relative to bolt latch slider 80. However, resilient member 202 does not hold bolt 86 with sufficient force to resist movement relative to bolt latch slider 80 in the event that a pellet is already present in breech bushing 52—such as where a user double cocks cocking and loading system 36 Where this occurs, bolt latch slider slides along bolt 86 to a portion of bolt 86 that is forward of a normal position. Accordingly, as bolt latch slider 80 is returned to a rearward position as the system is returned to a firing position, a rear end 204 of bolt 86 is thrust further rearward. In the embodiment of FIGS. 1-8 a bolt 86 cover optionally can be provided and can be positioned over portions of left housing 70 and right housing 76 with an opening such as opening 39 illustrated in FIG. 2 which is at a rearward portion of the portions of left housing 70 and right housing 76 and through which the rear end 204 of this differently positioned bolt 86 will project providing a visual indication of a loading problem.

In embodiments, the use of breech bushing 52 can allow a common shuttle to be used in airguns having either of a larger caliber barrel or a smaller caliber barrel. In one example of this, the shuttle passageway 124 can be sized larger than either of the larger caliber projectile and the smaller caliber projectile. Where a common shuttle 54 is to be used with a barrel of the larger caliber, a breech bushing 52 having a breech bushing channel 164 of the larger caliber can be combined with the common shuttle 54. Similarly, where the common shuttle 54 is to be used with a barrel of the smaller caliber, a breech bushing 52 having a breech bushing channel 164 of the smaller caliber can be combined with the common shuttle 54.

In embodiments, breech bushing 52 may have a breech bushing channel 164 with an outer diameter that is larger than the anticipated caliber of projectile to be loaded into breech bushing 52. Such a breech bushing channel 164 can then taper such that the size of breech bushing channel 164 is about the size of longitudinal passageway 66 at the interface there between.

In embodiments, breech bushing 52 may be adapted to more closely conform to the sizes, shapes or other characteristics of projectiles to be fired by airgun 10. Additionally, breech bushing 52 may be adapted to conform to the characteristics of particular batches or lots of projectiles to be used in airgun 10 and may be supplied by a manufacture with such batches or lots.

Although described as a bushing in the embodiments shown above, it will be appreciated that a breech bushing 52 can take other forms that can be movably positioned within shuttle passageway to provide functions associated with breech bushing 54.

The invention has been described in detail with particular reference to certain preferred embodiments thereof, but it will be understood that variations and modifications can be effected within the scope of the invention.

What is claimed is:

1. An airgun comprising:

a tube fork having front face with a port from which a compressed gas can flow;

a barrel having a passageway through the barrel with an opening at a back barrel face, with the passageway sized to receive a projectile;

a pivot joining the barrel to the tube fork such that the barrel can be moved between a firing position and a cocking position;

a shuttle positioned between the port and the barrel, the shuttle having a shuttle passageway with a front end of the shuttle passageway that is larger than at least one of the barrel passageway and the port;

a shuttle drive system configured to allow the shuttle to move so that the shuttle passageway is moved between a first position where a front end of the shuttle passageway overlaps the opening and where a back end of the shuttle passageway overlaps the port, and a second position where the shuttle passageway overlaps a loading opening of a projectile loading system; and, a breech bushing partially in the shuttle passageway and having a breech bushing channel sized to receive the projectile;

wherein the barrel has a barrel guide surface at the back barrel face, wherein the breech bushing has a shaped surface facing the barrel, and wherein the breech bushing shaped surface and the barrel guide surface are configured to interact as the barrel is moved from the cocking position to the firing position to urge a breech insert to move within the shuttle passageway in a manner that reduces any misalignment between the breech bushing channel and the opening.

2. The airgun of claim 1, wherein the breech bushing is formed using a stronger material than a material used to form the shuttle.

3. The airgun of claim 1, wherein the breech bushing is formed using a harder material than a material used to form the shuttle.

4. The airgun of claim 1, wherein movement of the barrel into the firing position exerts a force clamping the breech bushing between the rifle barrel and the fork tube.

5. The airgun of claim 1, wherein the barrel opening is substantially aligned with the tube fork port in a manner that reduces any misalignment between the breech bushing channel and the port.

6. The airgun of claim 1, wherein the barrel opening is substantially aligned with the port so that alignment of the barrel opening with the breech bushing channel substantially aligns the breech bushing channel with the port.

7. The airgun of claim 1, wherein the shuttle drive system urges the shuttle to move the shuttle passageway from the first position to the second position, and wherein the barrel has positioning beams arranged on opposite sides of the opening, and that move through a radius that brings the positioning beams into contact with shoulders of the shuttle as the barrel is rotated from the cocking position to the firing position.

8. The airgun of claim 7, wherein at least one of the shoulders and the barrel positioning beams has surfaces that are rounded such that contact with the other one of the shoulders and the barrel positioning beams occurs in a manner that will urge any matter not a part of the shoulders and the barrel positioning beams away from contact points to preserve alignment and positioning.

9. The airgun of claim 1, wherein the loading system comprises a magazine holder that holds a magazine so that a bolt can be advanced through a projectile storage chamber of the magazine to drive a projectile through a loading opening into the breech bushing channel when the shuttle drive positions the breech bushing channel adjacent to the barrel opening.

10. The airgun of claim 9, wherein the bolt is held for movement relative to the magazine by a resilient member, and wherein the resilient member holds the bolt with sufficient force to drive a single projectile into the breech bushing channel without substantially displacing the bolt relative to the resilient member.

11. The airgun of claim 10, wherein the resilient member does not hold the bolt with sufficient force to resist movement relative to a bolt latch slider, the bolt latch slider being configured such that when a projectile is present in the breech bushing channel, the bolt latch slider slides along the bolt to a portion of the bolt that is forward of a normal position.

12. The airgun of claim 11, further comprising a spur gear pivotally mounted to rotate with the barrel, a gear rack that engages the spur gear such that the gear rack slides as the spur gear rotates, wherein the gear rack has engagement features that engage engagement features of the bolt latch slider that is mounted such that the bolt latch slider slides to advance and retract the bolt as the barrel is rotated.

13. The airgun of claim 1, wherein the shuttle passageway is sized larger than a larger caliber projectile and a smaller caliber of projectile, wherein the breech bushing is one of a first breech bushing sized to fit in the shuttle passageway and having a breech bushing channel sized to receive the larger caliber projectile and a second breech bushing sized to fit in the shuttle passageway and having a breech bushing channel sized to receive the smaller caliber projectile.

14. The airgun of claim 1, wherein the barrel, the tube fork and the breech bushing are configured so that the barrel and tube fork apply a clamping force against the breech bushing without substantially applying the clamping force against the shuttle.

* * * * *